US006601833B2

(12) United States Patent
Takai et al.

(10) Patent No.: US 6,601,833 B2
(45) Date of Patent: Aug. 5, 2003

(54) CONTAINER FOR SPARKLING BEVERAGE AND BUBBLE GENERATING MEANS

(75) Inventors: Ryuzo Takai, Shiga (JP); Takashi Nakajima, Shiga (JP); Hiroaki Takahata, Shiga (JP); Kimiko Otani, 29-13, Fujimidai, Otsu-Shi, Shiga 520-0846 (JP)

(73) Assignees: Shiga Prefecture, Shiga (JP); Kimiko Otani, Shiga (JP)

( * ) Notice: Subject to any disclaimer, the term of this patent is extended or adjusted under 35 U.S.C. 154(b) by 0 days.

(21) Appl. No.: 09/864,600

(22) Filed: May 23, 2001

(65) Prior Publication Data

US 2002/0000678 A1 Jan. 3, 2002

(30) Foreign Application Priority Data

May 24, 2000 (JP) ..... 2000-153503

(51) Int. Cl.[7] ..... B01F 3/04

(52) U.S. Cl. ..... 261/121.1; 99/323.1; 206/0.7; 206/457; 261/122.1; 261/124; 261/DIG. 7; 426/477

(58) Field of Search ..... 261/122.1, 124, 261/DIG. 7, 121.1; 206/27, 457; 426/477; 99/323.1, 285

(56) References Cited

U.S. PATENT DOCUMENTS

| | | | | | |
|---|---|---|---|---|---|
| 2,081,029 | A | * | 5/1937 | Young | 261/DIG. 7 |
| 2,447,716 | A | * | 8/1948 | Rowe | 426/477 X |
| 3,578,295 | A | * | 5/1971 | Hudson | 261/DIG. 7 |
| 3,888,998 | A | * | 6/1975 | Sampson et al. | 426/477 X |
| 3,992,493 | A | * | 11/1976 | Whyte et al. | 261/DIG. 7 |
| 4,147,808 | A | * | 4/1979 | Liepa et al. | 426/477 |
| 4,186,215 | A | * | 1/1980 | Buchel | 426/477 X |
| 4,214,011 | A | * | 7/1980 | Strube | 426/477 X |
| 4,265,376 | A | * | 5/1981 | Skidell | 261/122.1 X |
| 4,482,509 | A | * | 11/1984 | Iannelli | 261/124 X |
| 5,624,645 | A | * | 4/1997 | Malley | 261/DIG. 7 |

FOREIGN PATENT DOCUMENTS

| | | | |
|---|---|---|---|
| GB | 2076628 | * 12/1981 | 99/323.1 |
| JP | 08242999 | 9/1996 | |
| JP | 08252159 | 10/1996 | |
| JP | 09206191 | 8/1997 | |
| JP | 10234549 | 8/1998 | |
| JP | 00051044 | 2/2000 | |

OTHER PUBLICATIONS

Junichi Kumada, "Froth of Beer", Biology & Chemistry, 13, 1975, pp. 504–509.

* cited by examiner

*Primary Examiner*—Richard L. Chiesa
(74) *Attorney, Agent, or Firm*—Milde & Hoffberg, LLP

(57) ABSTRACT

A container for a sparkling beverage which includes, on its inside bottom portion or surface, a bubble generator having a bubble generating portion for generating bubbles in such a manner that an aggregation of bubbles forms substantially the same shape as a mark on the surface of a beverage.

4 Claims, 8 Drawing Sheets

CONTAINER FOR SPARKLING BEVERAGE AND BUBBLE GENERATING MEANS

BACKGROUND OF THE INVENTION

1. Field of the Invention

The present invention relates to a container for a sparkling beverage such as beer and bubble generating means used therein, and more particularly to a container capable of keeping froth on beer for a long time and bubble generating means used therein.

2. Description of Related Art

It is often said that important factors for good beer are a shiny amber color, refreshing aroma, clean stimulating taste, and fine froth. Froth, or an aggregation of bubbles, is evaluated on the basis of bubble condition, bubble duration, bubble amount, bubble density and the like. (Junichi Kumada: "Froth of beer", Biology and chemistry 13, 1975, pp. 504–509

While a quality of liquid can be optimized by controlling production conditions and transportation conditions, a quality and amount of froth of beer depends on a beer cup and how to pour beer into the cup in addition to the above conditions. Accordingly, in order to regulate the amount of froth of beer, various types of beer cups have been proposed so far. For example, Japanese Unexamined Patent Publication No. (Patent Kokai No.) 10-234549 (1998) and 08-242999 (1996) disclose a container having microscopic asperities on the inside wall thereof to generate fine bubbles, Japanese Unexamined Patent Publication No. (Patent Kokai No.) 09-206191 (1997) discloses a container whose inside is partially narrowed to prevent an overflow of froth of beer, Japanese Unexamined Patent Publication No. (Patent Kokai No.) 08-252159 (1996) discloses a container with an aggregate of fine grains bonded to the bottom thereof to keep froth of beer for a long time, and Japanese Unexamined Patent Publication No. (Patent Kokai No.) 2000-051044 (2000) discloses a glass having a water repellent film layer and/or an oil repellent film layer on the surface thereof to keep froth of beer for a long time.

However, these containers and glass are difficult to manufacture or do not produce a satisfactory effect. For this reason, it has been desired to develop easier production method for a beer cup and better froth developing means.

When we drink sparkling beverage such as beer, a container gives us a visual pleasure as well. For example, Japanese Unexamined Patent Publication No. (Patent Kokai No.) 2000-051044 (2000) discloses a glass having a picture, a letter, or the like made of a water repellent film layer and/or an oil repellent film layer on the outer surface of the glass, which appears when cold beer is poured therein.

However, this glass has drawbacks. Such picture, letter, or the like disappears when a hand is touched thereon.

SUMMARY OF THE INVENTION

Accordingly, an object of the present invention is to provide a container for a sparkling beverage capable of forming a frothy picture, letter or the like on the surface of the beverage and keeping it for a long time and bubble generating means used therein.

A container for a sparkling beverage according to the present invention comprises a bubble generating portion having a coarse surface. The bubble generating portion is formed on the inside bottom portion of the container and is shaped into a predetermined mark indicating a certain message. The bubble generating portion generates bubbles in such a manner that an aggregation of the bubbles forms substantially the same shape as the mark on the surface of a beverage when the beverage is poured into the container.

In the container for a sparkling beverage according to the present invention, the bubble generating portion is formed on the inside bottom surface of the container.

The container for a sparkling beverage according to the present invention is a pottery container and the coarse surface thereof is unglazed, semi-glazed, or coated with a coarse-grained glaze.

In the container for a sparkling beverage according to the present invention, the coarse surface is formed by sandblasting one of a glass surface, a plastic surface, and a metal surface by a 50- to 1000-mesh powder.

In the container for a sparkling beverage according to the present invention, the bubble generating portion is formed on bubble generating means laid on the inside bottom portion of the container.

In the container for a sparkling beverage according to the present invention, the bubble generating means is detachably attached to the inside bottom portion of the container.

In the container for a sparkling beverage according to the present invention, the bubble generating means is placed on the inside bottom portion of the container.

In the container for a sparkling beverage according to the present invention, the bubble generating means is bonded to the inside bottom portion of the container with an adhesive.

In the container for a sparkling beverage according to the present invention, the bubble generating means includes a pottery portion and the coarse surface is an unglazed part, a semi-glazed part, or a part coated with a coarse-grained glaze on the pottery portion.

In the container for a sparkling beverage according to the present invention, a diameter of a circle equal to an aggregation of a part corresponding to a projection of an asperity on the coarse surface is in a range from 4.5 to 40 $\mu$m, wherein the asperities are extracted from a binary image.

Bubble generating means which is laid on an inside bottom portion of a container according to the present invention comprises a bubble generating portion having a coarse surface. The bubble generating portion is shaped into a predetermined mark indicating a certain message and generates bubbles in such a manner that an aggregation of the bubbles forms substantially the same shape as the mark on the surface of a beverage when the beverage is poured into the container.

The bubble generating means according to the present invention has the coarse surface on the one side thereof and an adhesive layer on the other side thereof.

In the bubble generating means according to the present invention, the adhesive layer is a pressure sensitive adhesive layer.

The bubble generating means according to the present invention includes a pottery portion and the coarse surface is an unglazed part, a semi-glazed part, or a part coated with a coarse-grained glaze on the pottery portion.

The bubble generating means according to the present invention includes a member made of glass, plastic, and metal and the coarse surface is formed on the member by sandblasting.

The bubble generating means according to the present invention comprises a predetermined base and a layer of a plurality of particles is applied to an upper surface of the base.

In the bubble generating means according to the present invention, the bubble generating portion is made of porous metal, porous glass, porous polymeric material, porous ceramic, and porous carbon.

In the bubble generating means according to the present invention, a diameter of a circle equal to an aggregation of a part corresponding to a projection of an asperity on the coarse surface is in a range from 4.5 to 40 $\mu$m. The asperities are extracted from a binary image.

DESCRIPTION OF THE PREFERRED EMBODIMENTS

Figure 1:
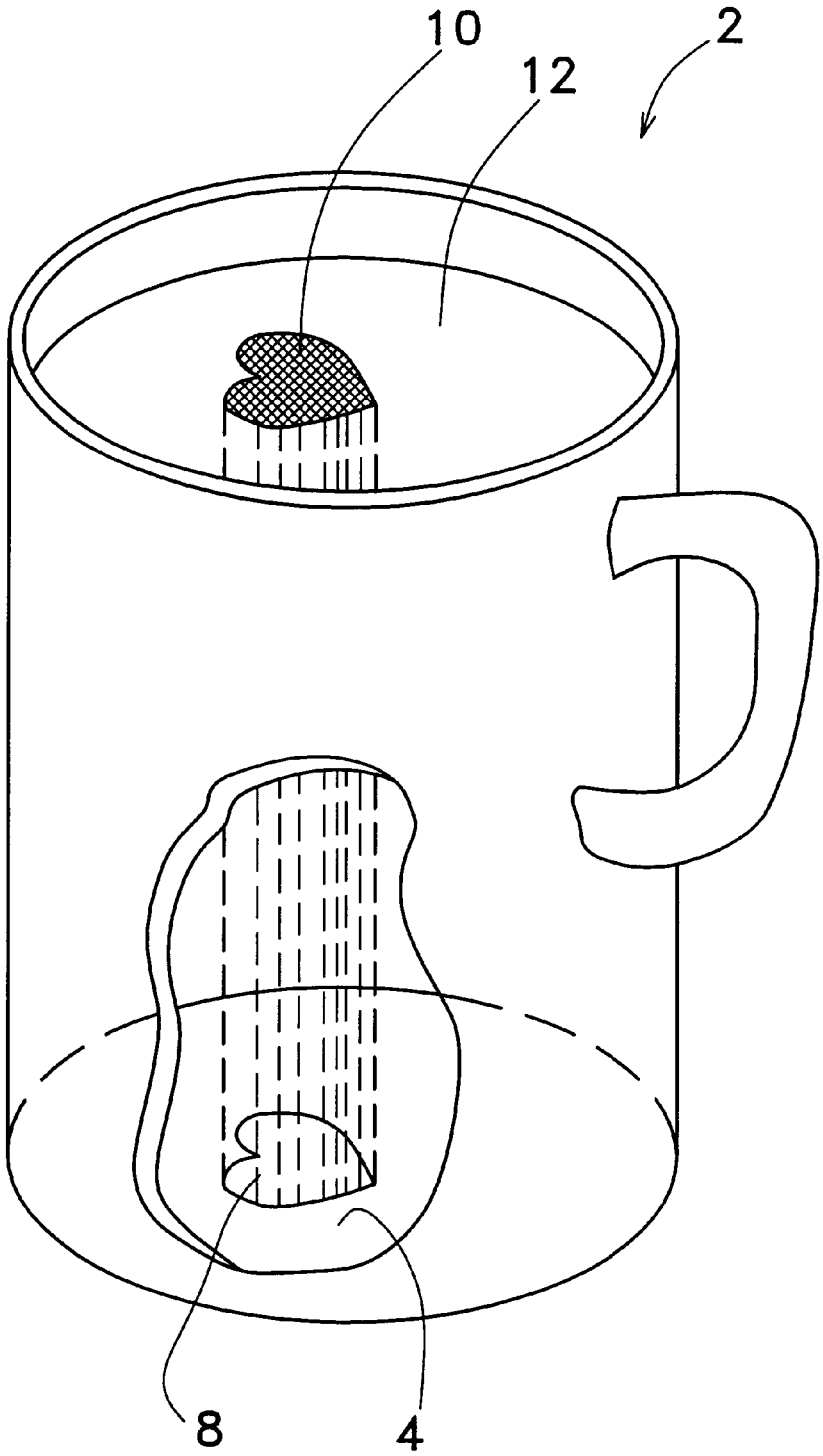
FIG. 1 is a perspective view of an embodiment of a container for a sparkling beverage according to the present invention.

An embodiment of the present invention will be described with reference to the accompanying drawings. A container 2 for a sparkling beverage shown in FIG. 1 is pottery, and a glaze is applied to at least all the inside surface of the cup other than a heart-shaped portion on the inside bottom surface 4 thereof. In this specification, the term "pottery" means objects made out of baked clay, such as ceramic and porcelain. When beer is poured into the container 2, the heart-shaped unglazed portion serves as a bubble generating portion 8 and generates small bubbles successively. On the other hand, the glazed portion has a smooth surface and develops only few bubbles. We can see the heart shaped portion 8 in the beer by the bubbles. Then the bubbles rise up to the surface 12 of the beer, and a heart mark 10 formed of bubbles is thereby embossed on the surface 12 of the beer. When the unglazed portion is in the middle of the inside bottom of the container, the heart mark of bubbles can be seen more clearly on the surface of the beer.

The container for a sparkling beverage according to the present invention has an opening at the top, which is wide enough to see a mark formed of bubbles. The container for a sparkling beverage according to the present invention is not limited to a pottery container, but it can be made of glass, metal, plastic, wood, or any other material that can hold a sparkling beverage. Preferable shape of the container is like wine glass, beer mug, bowl, tureen, and the like.

The process of producing the unglazed portion, or a bubble generating portion, is as follows: First, an unglazed pottery container is prepared. Second, a masking sheet from which a desired mark is cut away is applied to the inside surface of the container, and then a water repellent is sprayed or brushed on the container. Thus, the water repellent is applied only to a portion which is not covered with the masking sheet. Third, the masking sheet is stripped off. A glaze is then applied to the inside surface of the container, but the portion where water repellent was applied repels the glaze. Fourth, the container is baked. In this baking step the water repellent is decomposed and burnt up by fire. Thus the unglazed portion, or bubble generating portion, is produced.

As described above, a frothy mark can be easily embossed on the surface of a beverage by using a very easy method in which a glaze is not applied onto a desired mark on the inside bottom surface of a container. In this specification, the term "mark" includes a letter, picture, code and the like.

Figure 2:
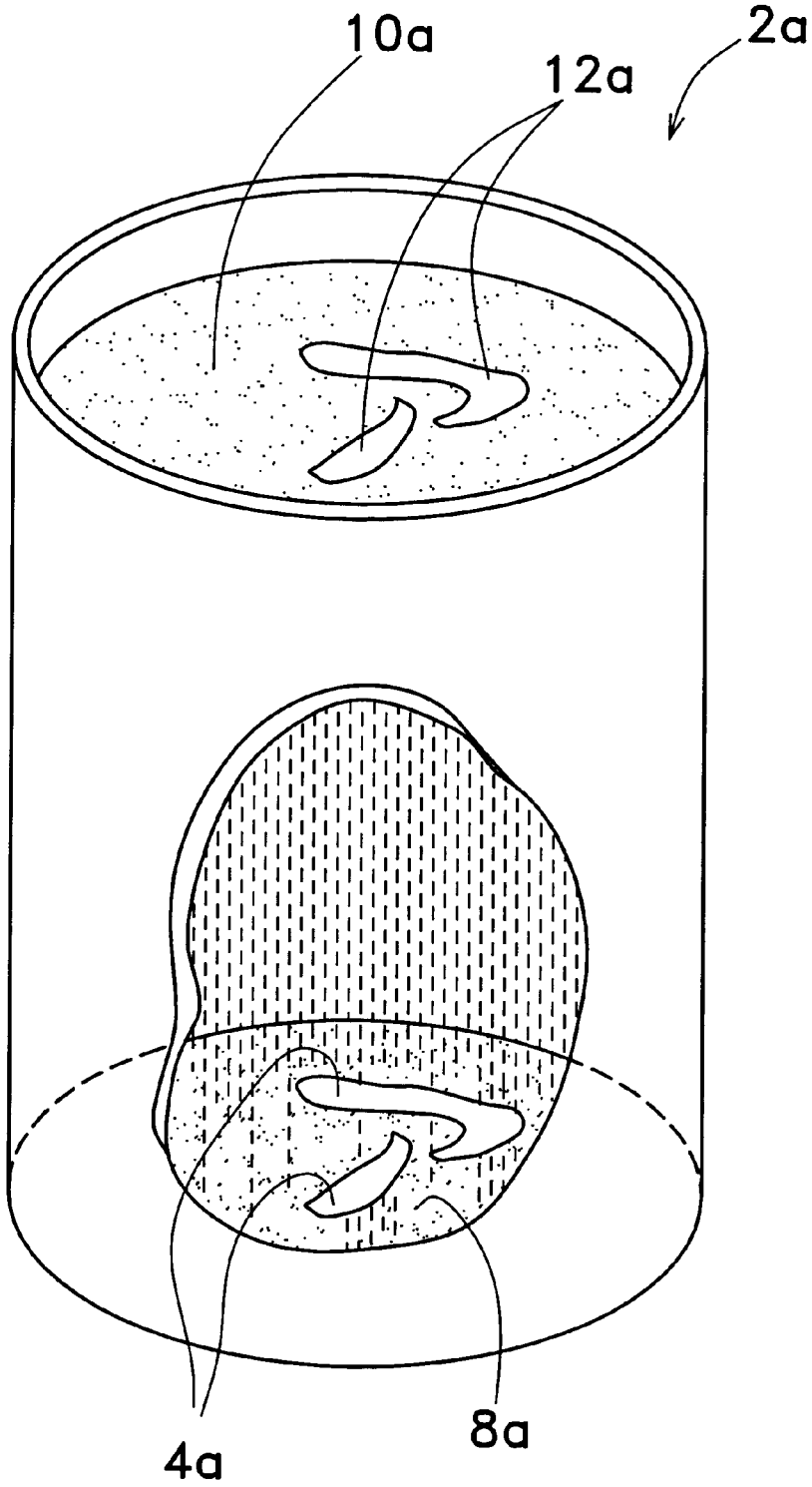
FIG. 2 is a perspective view of another embodiment of a container for a sparkling beverage according to the present invention.

Alternatively, a glaze can be applied to a desired mark on the inside bottom surface of a container 2*a* to produce a glazed portion 4*a*, as shown in FIG. 2. In this case, the inner bottom surface other than the portion 4*a* serves as a bubble generating portion 8*a*, and a mark 12*a* appears on the surface of a beverage by being enclosed by froth 10*a*.

The glaze can be applied to the inner surface of the container with brush or stamp to produce a glazed portion in the shape of a desired mark. Further, in order to produce a bubble generating portion, an engobe having a predetermined grain size or coarse-grained glaze can be applied to the container.

A mark which appears on the surface of beer is not particularly limited. Examples of the mark may include a name or initial of a person or an owner of a beer cup, the date of a special event, and a mark of a group.

Where most of the inside bottom surface of a container is unglazed, bubbles are continuously generated and froth is kept long on the surface of beer, whereby the appearance and taste of the beer can be improved.

The bubble generating portion can be unglazed or can be coated with a dilute solution of a glaze. When a dilute solution is applied, the amount of froth is reduced but froth can last longer and a mark appears more clearly on the surface of beer. When the container is made out of clay of too small grain, the lasting time of froth is decreased as the container is repeatedly used. Conversely, when the container is made out of clay of too large grain, more amount of froth is developed, but the lasting time of froth is decreased. Preferable grain size of clay is in the range of 35 to 70 $\mu$m. In this range, froth lasts longest. When the clay is mixed with coarse-grained feldspar and/or quartzite, the amount of froth is increased. Preferable baking temperature is 1000° C. to 1300° C. Although the container baked at a temperature ranging from 1100° C. to 1300° C. develops less amount of froth than the one baked at a lower temperature, the froth lasts longer.

In the case of an unglazed container which is made out of clay of grain size less than 35 $\mu$m, a preferable bubble generating portion can be formed by applying a dilute solution of a glaze to the container and then baking it, and thus the lasting time of froth can be increased. When an unglazed container is baked after a dilute solution of a glaze is applied thereto, microscopic asperities on the surface of the container is partly covered with the solution, so that the asperities become gentle. A portion having such gentle asperities on the surface of the container is referred to as a "semi-glazed portion" in this specification. A semi-glazed portion, or a bubble generating portion, is produced by the same method as the unglazed portion is produced using a water repellent. The semi-glazed portion can generate long lasting fine froth, so that a mark appears more clearly on the surface of a beverage.

Another embodiment of the present invention will be described with reference to the accompanying drawings. In a container 2*c* for a sparkling beverage shown in FIG. 3, bubble generating means 100 is placed on the inside bottom 3. The means 100 is shaped like a disc, and is made out of baked clay. A glaze is applied to at least all the upper surface of the means 100 except a heart mark. When beer is poured into the container 2*c*, the unglazed heart-marked portion serves as bubble generating means 8 and generates small bubbles successively. On the contrary, since a smooth surface 14 is covered with the glaze, it generates few bubbles. Thus, we can see the heart shaped portion 8 in the beer by the bubbles. The bubbles then rise up to the surface 12 of the beer, and a frothy heart mark 10 appears on the surface 12 of the beer.

The process of producing the unglazed portion, or bubble generating means 100, is as follows: First, an unglazed pottery disc is prepared. Second, a masking sheet from which a desired mark is cut away is applied to the upper surface of the disc, and then a water repellent is sprayed or brushed on the surface of the disk. Thus, the water repellent is applied only to a portion which is not covered with the masking sheet. Third, the masking sheet is stripped off. A glaze is applied to the upper surface of the disc, but the portion where water repellent was applied repels the glaze. Forth, the disc is baked. In this baking step, the water repellent is decomposed and burnt up by fire, and thus the unglazed portion is produced.

Figure 4:
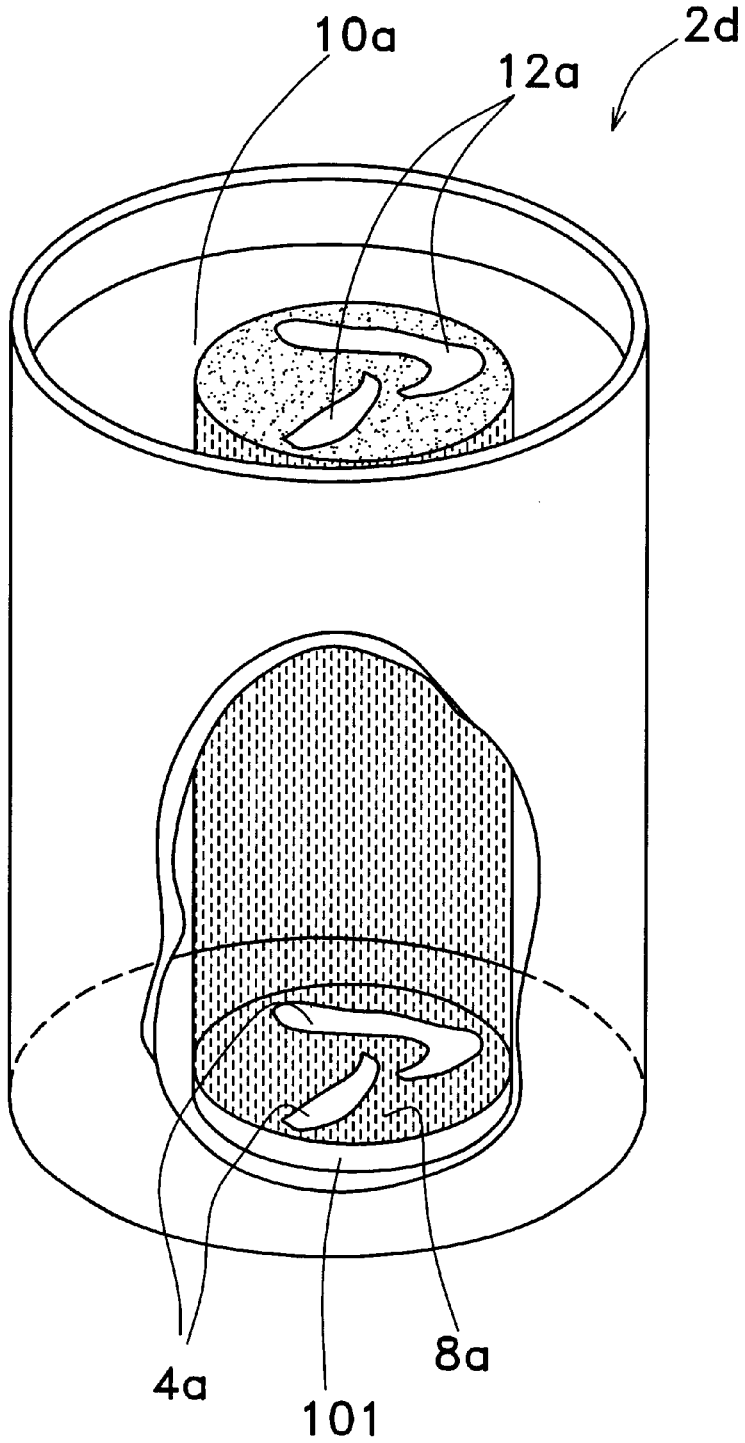
FIG. 4 is a perspective view of a further embodiment of a container for a sparkling beverage according to the present invention.
Figure 5A:
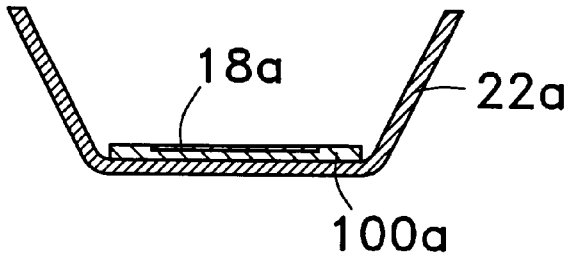
FIGS. 5(*a*) to 5(*e*) are sectional views showing various embodiments of bubble generating means laid on the bottom of a container according to the present invention.
Figure 5B:
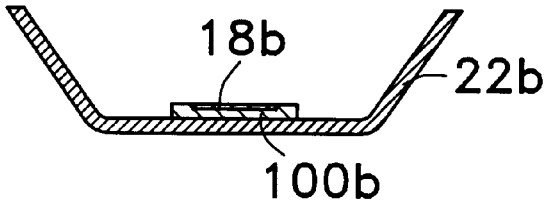
Figure 5C:
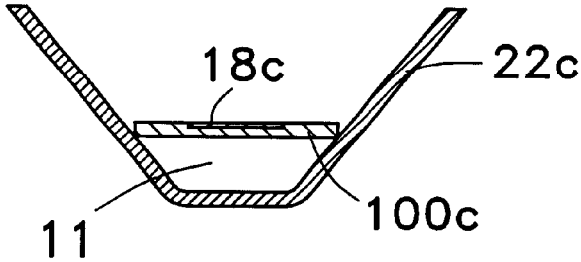
Figure 5D:
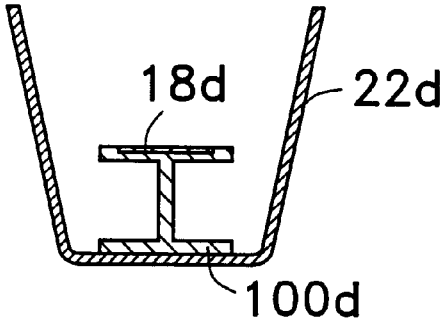
Figure 5E:
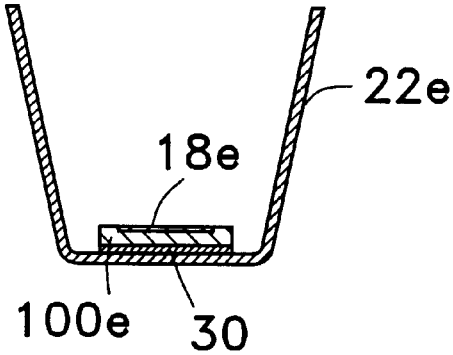
Figure 6A:
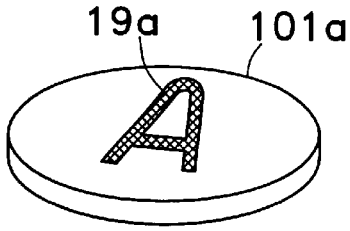
FIGS. 6(*a*) to 6(*f*) are perspective views showing various embodiments of bubble generating means according to the present invention.
Figure 6B:
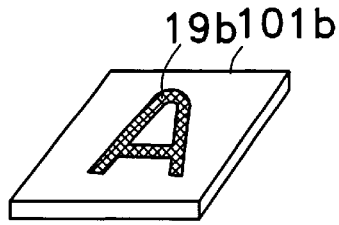
Figure 6C:
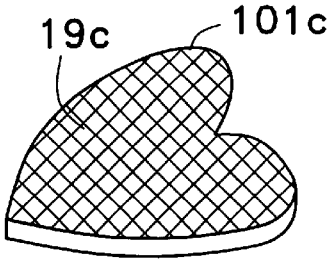
Figure 6D:
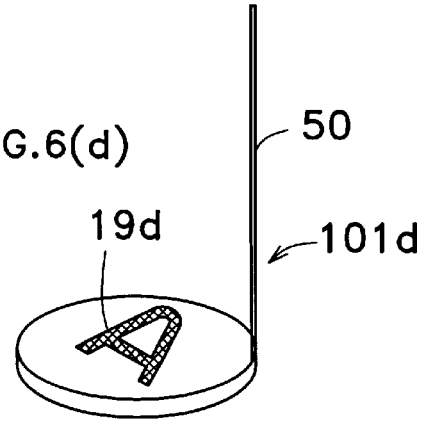
Figure 6E:
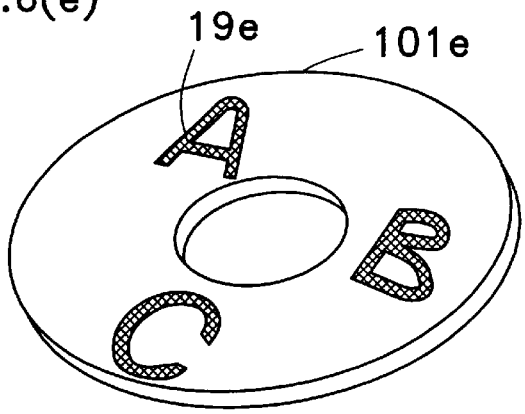
Figure 6F:
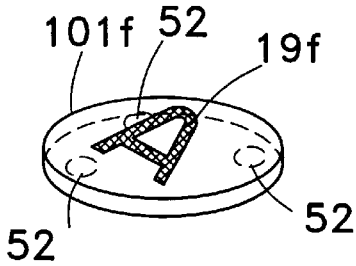

Alternatively, in a container 2*d* shown in FIG. 4, a glaze is applied to a desired mark portion on the upper surface of bubble generating means 101 to produce a smooth glazed portion 14*a* in the shape of the desired mark. In this case, the upper surface of the disk 101 other than the portion 14*a* serves as a bubble generating portion 8*a*, and a mark 12*a* appears on the surface of a beverage by being enclosed by froth 10*a*. The size of the froth 10*a* is substantially the same as that of the means 101.

The glaze can be applied to a clayware with brush or stamp to produce a glazed portion in the shape of a desired mark. Further, in order to produce the bubble generating portion, an engobe having a predetermined grain size or coarse-grained glaze can be applied to a clayware.

Figure 3:
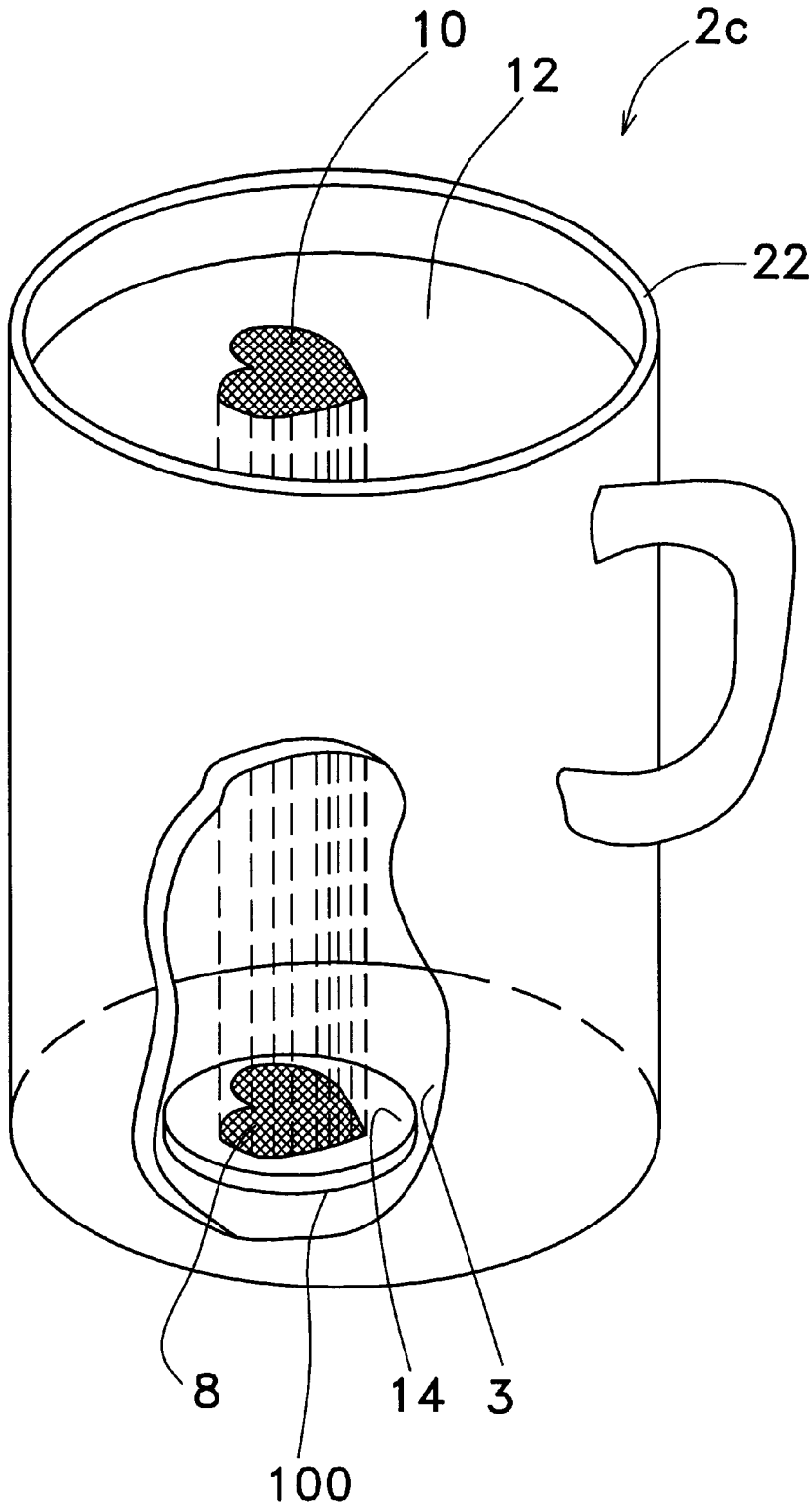
FIG. 3 is a perspective view of still another embodiment of a container for a sparkling beverage according to the present invention.

In embodiments as shown in FIGS. 3 and 4, the bubble generating portion is not necessarily formed directly on the inside bottom portion (herein referred to simply as "bottom") of the container for a sparkling beverage (herein referred to simply as "container"), but flat bubble generating means having a bubble generating portion can be placed on or fixed to the bottom of the container. Therefore, the bubble generating portion can be more easily produced. Alternatively, various combinations of bubble generating means and containers can be brought to a market. Unlike the container with bubble generating portion formed directly on the inside bottom thereof, there is no limitation on the container itself, so that various commercially-available container can be used in combination with the bubble generating means. In addition, the bubble generating means can be in any shape. Since the bubble generating means can be produced separately form the container, a bubble generating portion can be formed more easily on the bubble generating means than it is formed directly on the container. Further, the bubble generating means is compact and lightweight, so that it can be easily stored, transported, or carried. Various types of bubble generating means can be produced and can be used in combination with various types of containers.

The bubble generating means can be shaped like a dish. Therefore, the bubble generating means can also be used as an eating utensil, saucer, or he like.

FIGS. 5(*a*) to 5(*e*) are sectional views showing various embodiments of bubble generating means placed on the inside bottom portion of the container. In FIGS. 5(*a*) to 5(*e*), numerals 18*a*, 18*b*, 18*c*, 18*d*, and 18*e* indicate a froth developing portion. In FIG. 5(*a*), bubble generating means 100*a* is placed all over the inside bottom of a container 22*a*. In FIG. 5(*b*), bubble generating means 100*b* is placed on a part of the inside bottom of a container 22*b*. In FIG. 5(*c*), bubble generating means 100*c* larger than the inside bottom of a container 22*c* is put into the container, so that not all the bottom surface of the means 100*c* contacts the inside bottom of the container 22*c*. In FIG. 5(*d*), bubble generating means 100*d* which is H-shaped in cross section is placed on the inside bottom of a container 22*d*. In this embodiment, the distance between the surface of a beverage and a bubble generating portion 18*d* can be reduced, so that a mark appears more clearly on the surface of the beverage.

As shown in FIG. 5(*e*), bubble generating means 100*e* can be bonded to the inside bottom of a container 22*e* with an adhesive 30. The means 100*e* is thereby fixed to the container, so that a mark stably appears on the surface of a beverage even when the container 22*e* is tilted or given a shock. The means 100*e* can be permanently bonded to the inside bottom of the container 22*e*. Alternatively, the means 100*e* backed to a rubber, acrylic, or silicon pressure sensitive adhesive or the like can be temporarily or detachably bonded to the inside bottom of the container. In this case, one bubble generating means can be used in various containers, or various means can be used in one container to enjoy a frothy mark.

FIGS. 6(*a*) to 6(*f*) show various embodiments of bubble generating means according to the present invention. In FIGS. 6(*a*) to 6(*f*), the numerals 19*a*, 19*b*, 19*c*, 19*d*, 19*e*, and 19*f* indicate a bubble generating portion. FIG. 6(*a*) shows disc-shaped bubble generating means 110*a*, which is suitable for placing all over the inside bottom of a cylindrical container. FIG. 6(*b*) shows plate-like bubble generating means 101*b*, which is suitable when a plurality of bubble generating means are used in one container. FIG. 6(*c*) shows a flat bubble generating means 110*c* whose whole surface is a bubble generating portion. FIG. 6(*d*) shows bubble generating means 110*d* with a holding stick 50. The stick 50 is suitably used when the means 110*d* is taken in and out of a container. FIG. 6(*e*) shows ring-shaped bubble generating means 100*e*. When a container has a rise in the center portion of the inside bottom thereof, the rise is fit into the hole of the means 101*e*, so that the means 101*e* can be fixed to the inside bottom of the container. FIG. 6(*f*) shows bubble generating means 110*f* with a bubble generating portion on the one surface thereof and a pressure sensitive adhesive 52 on the other surface thereof. Therefore, the means 110*f* is bonded to the inside bottom of a container with the adhesive 52, so that the means 101*f* can be fixed to the inside bottom of the container. Since the means 110*f* can be easily detached from the bottom, the means 101*f* is suitable for temporary use in a container.

Figure 7A:
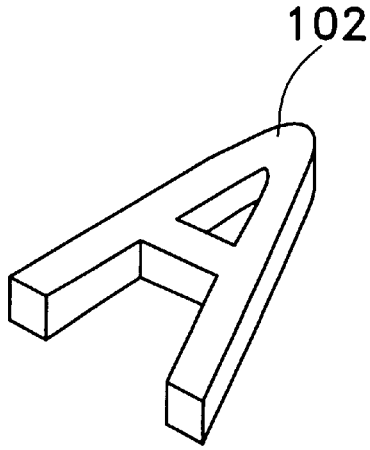
FIGS. 7(*a*) to 7(*c*) are perspective views showing different types of bubble generating means from the ones shown in FIGS. 6(*a*) to 6(*f*) according to the present invention.
Figure 7B:
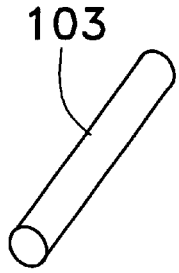
Figure 7C:
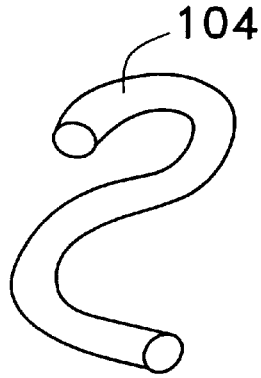

Bubble generating means 102, 103, and 104 shown in FIGS. 7(*a*) to 7(*c*) are unglazed pottery or pottery to which a dilute solution of a glaze is applied. In order to produce such bubble generating means 102, 103, and 104, rod-like clay is shaped into a desired letter or mark by bending or connecting, and then it is baked without applying any glaze or with applying a dilute solution of a glaze thereto. Alternatively, a desired letter or mark can be cut out from clay with something like a cookie cutter, and then it is baked without applying any glaze or with applying a dilute solution of a glaze thereto. These bubble generating means can be substantially rectangular in cross section as shown in FIG. 7(*a*) or substantially circular in cross section as shown in FIGS. 7(*b*) and 7(*c*). The means shown in FIGS. 7(*a*) to 7(*c*) generate bubbles from substantially all the surfaces, so that the froth can last longer and a mark appears more clearly.

The bubble generating means of such shape can be formed of a porous material such as sintered metal, porous glass, polymeric material such as open cell plastic, natural or artificial porous ceramic, porous fiber material such as paper and felt, or porous fiber made of natural polymer, synthetic polymer, metal, carbon or the like, and porous carbon such as charcoal. Porous carbon is preferably used because it can purify a liquid in a container. The bubble generating means can be produced by cutting or bonding the aforementioned porous member.

The aforementioned porous member itself can be used as bubble generating means. Alternatively, such porous member can be bonded to a substrate with an adhesive to use it as bubble generating means. Further, such porous member can be pulverized into small particles. These particles are bonded to a predetermined part of a substrate to produce a mark on the substrate, and thus the substrate with the particles can be used as bubble generating means.

The bubble generating portion (coarse surface) of the bubble generating means can be a layer of particles bonded to a flat base of a predetermined shape. In this case, an average size of the particles is about 5 to 100 $\mu$m. The material of particles is not particularly limited, as far as it is water-insoluble. Examples of particles include sand, glass powder, plastic powder, metal powder, and carbon powder.

As shown in FIGS. 7(*a*) to 7(*c*), the bubble generating means can be shaped like a letter, special character, or number. A plurality of such means can be used in combination so that a certain message may appear on the surface of a beverage.

The bubble generating means can be a glass plate, a metal plate or a plastic plate. The surfaces of these plates are sandblasted to produce a bubble-generating coarse surface.

The bubble generating means according to the present invention can be a plastic film. In this case, the one surface of the film is sandblasted or stamped to produce a coarse surface, and the other surface is backed with a double-bonded adhesive tape or an adhesive to adhere to the inside bottom of a container. Alternatively, a hot melt adhesive or a press sensitive adhesive can be applied to the other surface in advance of bonding the means to a container. The film-like bubble generating means is compact and lightweight, so that it can be easily stored, transported, or carried. Further, the film-like bubble generating means can easily conform to the container even if there are asperities on the surface thereof. An adhesive backed on the film-like bubble generating means allows the user to easily bond the means to the inside bottom of a container at any desired time.

As described above, the shape of the bubble generating means is not limited to a disk, but the bubble generating means can be a rectangular plate or any polygonal plate. Preferably, the thickness of the disk- or plate-like means ranges from 0.05 to 20 mm for ease of handling and producing. More preferably, the thickness of the bubble generating means except film-like means ranges from 0.5 to 10 mm for ease of handling and producing.

The shape of the bubble generating means according to the present invention is not particularly limited, as far as it is bonded to the inside bottom portion of a container with a coarse surface up.

The bubble generating means according to the present invention can be placed directly on the inside bottom of a container. However, in the case of a truncated conical container as shown in FIG. 5(*c*), the bubble generating means can be placed against the inside wall of a container. Alternatively, the bubble generating means can be suspended from the edge of the container, using suspending means.

(Measurement of a Ratio of Froth to Beer and Froth Disappearing Speed)

The ratios of froth to beer and froth disappearing speeds in various containers were measured by pouring beer thereinto. The beer used in this measurement was Asahi draft beer (Asahi Breweries Limited) having a temperature of 4° C., and was poured into respective containers from a 10-litter beer keg with a small beer server at a constant gas pressure and a constant poring speed. The containers used in that measurement were cleaned with a neutral detergent, rinsed out with ion exchange water, and then dried, before using.

The results of the measurement were shown in Table 1.

TABLE 1

| Sample container | Particle size ($\mu$m) | Glaze | quartzite • feldspar | Ratio of froth to beer (%) | Froth disappearing speed (m/sec) | Asperity size ($\mu$m) |
|---|---|---|---|---|---|---|
| 1 | 163 | N | none | 85 | 0.30 | 39.4 |
| 2 | 73 | N | none | 84 | 0.31 | — |
| 3 | 70 | N | none | 76 | 0.27 | 18.9 |
| 4 | 70 | T | none | 60 | 0.05 | — |
| 5 | 50 | N | none | 75 | 0.26 | — |
| 6 | 35 | N | none | 77 | 0.27 | — |
| 7 | 29 | N | none | 77 | 0.28 | — |
| 8 | 20 | N | none | 78 | 0.29 | — |
| 9 | 50 | T | none | 15 | 0.01 | 22.4 |
| 10 | 50 | T | presence | 35 | 0.06 | 31.2 |
| 11 | 50 | S | none | 56 | 0.11 | 18.2 |
| 12 | 50 | G | none | 5 | 0.33 | — |
| 13 | 20 | T | none | 10 | 0.01 | 22.6 |
| 14 | 30 | T | none | 20 | 0.02 | — |
| 15 | 10 | T | none | 20 | 0.05 | — |
| Glass | — | — | — | 20 | 0.23 | — |
| Glass 40 | — | — | — | 70 | 0.45 | 41.0 |
| Glass 50 | — | — | — | 70 | 0.32 | 35.9 |
| Glass 80 | — | — | — | 75 | 0.31 | 21.7 |
| Glass 200 | — | — | — | 72 | 0.27 | 19.1 |
| Glass 600 | — | — | — | 68 | 0.28 | 16.1 |
| Glass 800 | — | — | — | 62 | 0.28 | 13.9 |
| Glass 1000 | — | — | — | 55 | 0.31 | 10.0 |
| Glass 1200 | — | — | — | 30 | 0.25 | 8.4 |
| PMMA50 | | | | 70 | 0.45 | 39.9 |
| PMMA1000 | | | | 58 | 0.34 | 11.8 |
| Aluminum 50 | | | | 45 | 0.30 | 22.0 |
| Aluminum 1100 | — | — | — | 21 | 0.25 | 4.4 |

The beer was poured into each container, and the height of froth was measured immediately after pouring, after 10 seconds, 30 seconds, 60 seconds and 120 seconds. The volume of froth having a maximum height was measured. The results of the measurements are shown in Table 1 as a ratio of froth to beer. A particle size of clay was measured using a laser diffraction type Particle Size Distribution Analyzer SALD-3000 (Shimadzu Corp.) Table 1 shows a size of particle whose cumulative frequency is 90% in a cumulative distribution curve of grain sizes. The particle size shown in Table 1 is bigger than the average particle size of clay, however, it is defined as a particle size of clay in this specification because a bigger particle makes more contribution to the generation of bubbles. In Table 1, the mark "G" indicates that a glaze which was not diluted is applied to a container, the mark "T" indicates a dilute solution of a glaze is applied thereto, the mark "S" indicates a more diluter solution of a glaze is applied thereto, and the mark "N" indicates that no glaze is applied thereto. A container coated with a more dilute solution of a glaze has a close-to-unglazed surface. In Table 1, "presence" indicates that quartzite and feldspar are contained in clay, and "none" indicates otherwise. When quartzite and feldspar are contained in clay, bigger asperities are formed on the surface of a container.

The "froth disappearing speed" shown in Table 1 is an average disappearing speed of froth. The "asperity size" shown in Table 1 is determined as follows:

While light is being applied to a coarse surface of a container from a top, an image of the coarse surface magnified by 175 times is detected by a digital microscope (KEYENCE CORPORATION). The detected image is changed into binary image by the Image Analyzer V20 (Toyo Boseki Co.). Aggregations of parts corresponding to projections of asperities are extracted from the binary image by the Image Analyzer. Diameters of circles equal in area to the extracted aggregations are determined. Finally, by averaging thus obtained diameters, the "asperity size" is obtained. In this case, a threshold is achieved by trail and error, and a binary image which is the closest to the actual image is adopted.

In Table 1, the numbers "1" to "15" in the "sample container" column indicate pottery containers of different shapes, and "glass" indicates a glass container. The "glass 40", "glass 50", "glass 80", "glass 200", "glass 600", "glass 800", "glass 1000", and "glass 1200" indicate that the inside surface of a container is sandblasted by a 40-mesh powder, 50-mesh powder, 80-mesh powder, 200-mesh powder, 600-mesh powder, 800-mesh powder, 1000-mesh powder, and 1200-mesh powder, respectively to achieve a coarse surface. The "PMMA50" and "PMMA1000" indicate that containers are made of polymethyl methacrylate and that the inside surfaces thereof are sandblasted by 50-mesh powder and 1000 mesh powder, respectively. The "Aluminum 50" and "Aluminum 1000" indicate that containers are made of aluminum and that the inside surfaces thereof are sandblasted by a 50-mesh powder and 1000-mesh powder, respectively.

When beer was poured into a glass container, a container made of polymethyl methacrylate, and an aluminum container, which have a mark sandblasted by a 50- to 1000-mesh powder on the inside bottom surface thereof, a frothy mark appeared clearly on the surface of the beer. However, when beer was poured into a glass container, a container made of polymethyl methacrylate, and an aluminum container, which have a mark sandblasted by a less than 50 mesh powder on the inside bottom surface thereof, rough bubbles were rapidly generated. For this reason, a frothy mark did not clearly appear on the surface of the beer and the froth disappeared fast. When beer was poured into a glass container, a container made of polymethyl methacrylate, and an aluminum container, which have a mark sandblasted by a more than 1000 mesh powder on the inner surface thereof, only a small amount of bubbles are generated and a frothy mark was unrecognizable.

As in the case of the container made of polymethyl methacrylate, when beer was poured into a plastic container made of polyethylene resin, polypropylene resin, polystyrene resin, or the like and having a mark sandblasted by a 50- to 1000-mesh powder on the inside bottom surface thereof, a frothy mark appeared clearly on the surface of the beer. Compared to a pottery container, the lasting time of froth was shorter in the plastic container, but a frothy mark appeared more clearly on the surface of the beer.

In the above measurements, a coarse surface was formed directly on the inside bottom surface of each container. However, the same results could also be achieved by placing a flat bubble generating means having a coarse surface thereon on the inside bottom of the container.

In the case of a plastic container or a plastic bubble generating means according to the present invention, a coarse surface can be formed by injection molding. Alternatively, it can be formed using a stamping die of a desired shape with a coarse surface thereon. In this case, the stamping die and/or a plastic container is/are subjected to heat, and then the stamping die is stamped on the inside bottom surface of the container.

As in the case of the aluminum container, when beer was poured into a metal container made of stainless, copper, or the like with a mark sandblasted by a 50- to 1000-mesh powder on the inside bottom surface thereof, a frothy mark appeared clearly on the surface of the beer. Compared to a pottery container, a froth lasted shorter in a metal container, but a frothy mark appeared clearly enough on the surface of beer.

In the case of a metal container or metal bubble generating means according to the present invention, a coarse surface can be formed by filing the inside bottom surface of the container or the surface of the means. Alternatively, the coarse surface can be formed by cutting grooves into the inside bottom surface of the container or the surface of the means in various directions on a lathe or the like. Alternatively, the coarse surface can be formed by etching a predetermined portion of the surface of the metal container or the means.

Regardless of a material of the container or the means, a frothy mark lasted long when the average asperity size was in a rage from 4.5 to 40 $\mu$m. Preferably, a frothy mark lasted long and clearly on the surface of beer when the average asperity size was in a rage from 8 to 30 $\mu$m.

Figure 8:
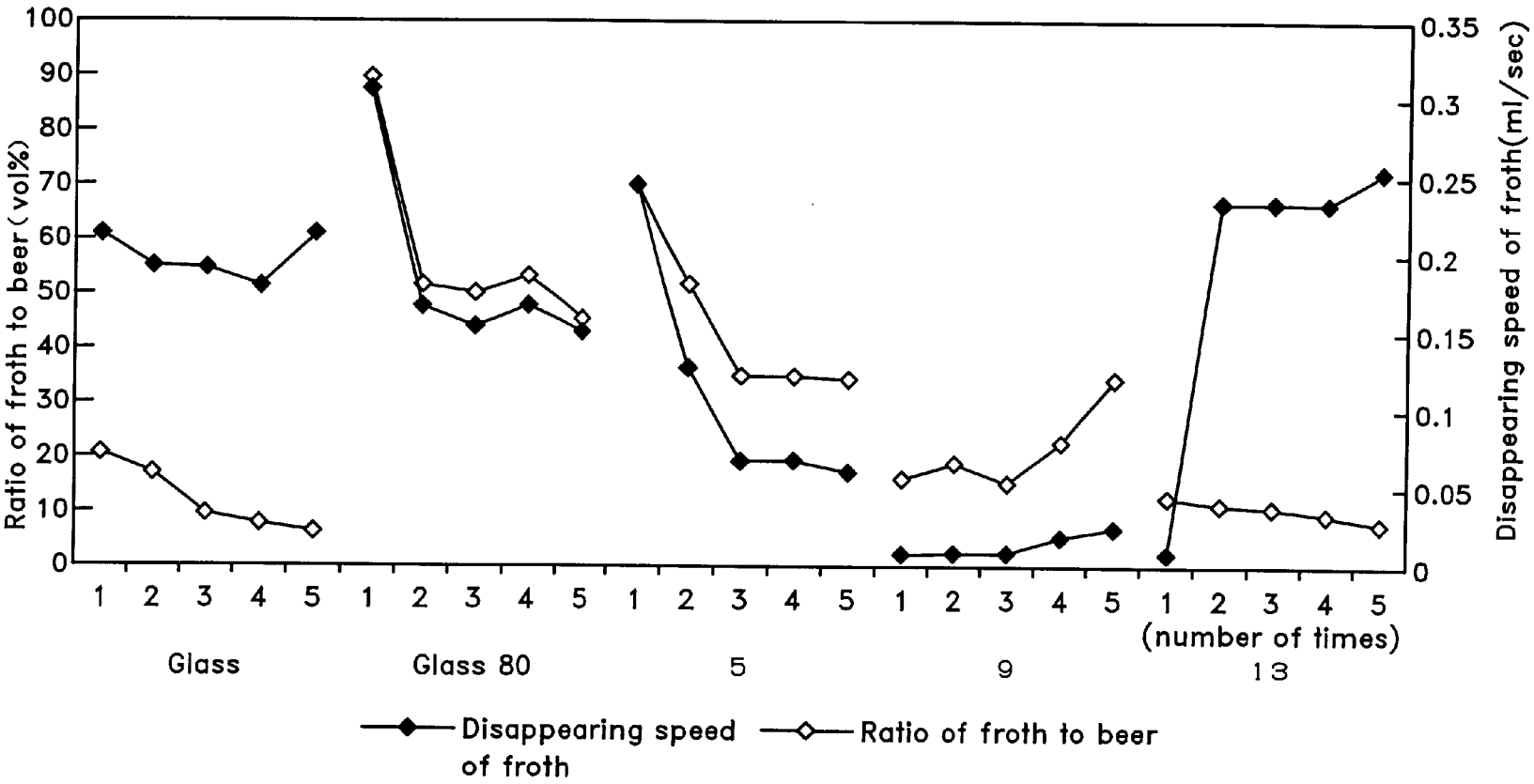
FIG. 8 is a graph showing the number of times that beer is poured into various containers for a sparkling beverage, the ratios of froth to beer, and the disappearing speeds of froth.

The ratios of froth to beer and froth disappearing speeds in various containers were measured by pouring beer thereinto. Results of the measurements are shown in FIG. 8. In FIG. 8, the horizontal axis of a graph indicates the number of times that a process of pouring beer into a container, leaving it alone for a minute, and then emptying out the container was performed. The "glass" indicates a glass container, "glass 80" indicates a glass container whose inside bottom surface was sandblasted by a 80-mesh powder, and "5", "9", and "13" indicate the same sample pottery containers as the ones shown in Table 1, respectively.

As obvious from FIG. 8, in the case of the sample container "9", a disappearing speed of froth is low even when the process is repeatedly performed. In the case of the sample container "13", a disappearing speed of froth is the lowest in the first process. Thus, in the case of a container made of clay of grain size less than 35 $\mu$m and coated with a glaze, a disappearing speed of froth is very low in the first process. A grain size of clay is not particularly limited to minimize a disappearing speed of froth in the first process, as far as it is industrially available. However, it is preferable that a grain size of clay is 10 μm or more in consideration of workability and productivity. As obvious from FIG. 8 and Table. 1, a container made out of clay of grain size raging from 35 to 70 μm has better balance between a ratio of froth to beer and a disappearing speed of froth.

Where a bubble generating portion is an unglazed pottery or a sandblasted glass, too much froth is generated in aesthetic terms. In addition, the generation of too much froth causes an excessive ejection of carbon dioxide from beer, so that a container having such portion is not suitable for a beer cup. On the contrary, where a dilute solution of a glaze is applied to a bubble generating portion, a frothy mark appears more clearly on the surface of beer.

Table 2 shows a relationship between the number of times that beer is poured and the lasting time of froth in various containers.

TABLE 2

| Sample container | first | second | third | forth | fifth |
|---|---|---|---|---|---|
| Glass | 98 | 81 | 45 | 39 | 24 |
| Glass 80 | 456 | 283 | 325 | 318 | 362 |
| 5 | 467 | 778 | 748 | 696 | 703 |
| 9 | 1415 | 1621 | 1635 | 1639 | 1612 |
| 13 | 1866 | 50 | 49 | 40 | 31 (second) |

The lasting time of froth means the time elapsed after the froth becomes the highest and before the surface of the beer appears from the froth. The terms "first", "second", "third", "forth" and "fifth" in the first row of the Table 2 indicate the number of times that the process of pouring beer into a container, leaving it alone for a minute, and then emptying out the container was performed. As obvious from Table 2, froth could last the longest in the sample container "9" at each time. In the case of the sample container "5", froth did not last very long in the first process, but the lasting time of froth became longer and stabilized when the process was repeatedly performed. In the case of the sample container "13", froth could last very long in the first process, but the lasting time of froth became shorter when the process was repeatedly performed.

As shown in FIG. 8, when beer was poured into a glass container (not sandblasted) for the first time (namely, when the container was dry), the ratio of froth to beer was about 20%, which is the most preferable ratio in aesthetic terms. However, when the container was repeatedly used, the ratio of froth to beer decreased gradually, and the ratio dropped to 6.5% for the fifth time. As shown in Table 2, the lasting time of froth decreased with the ratio of froth to beer, and the froth lasted only 24 seconds for the fifth time. In the case of a sandblasted glass container (glass 80), the ratio of froth to beer sharply dropped for the second time, but the ratio was maintained nearly constant from the second time. Compared to the glass container (not sandblasted), the disappearing speed of froth was high in the sandblasted glass container.

Likewise, in the case of a unglazed pottery container, the ratio of froth to beer sharply decreased for the second time, but the ratio was maintained nearly constant from the third time. Compared to the glass container (not sandblasted) and sandblasted glass container, the disappearing speed of froth was low in the unglazed pottery container.

In the above measurements shown in FIG. 8 and Table 2, a coarse surface was formed directly on the inside bottom surface of each container. However, the same results could also be achieved by placing a flat bubble generating means having a coarse surface on the bottom of the container.

It is well-known that a molecule in a gaseous state is absorbed on the surface of a solid at an interface between the gas and the solid by a weak attractive force such as van der Waals force. Further, it is also known that when an absorbent (namely, the inside surface of a beer cup) has capillary pores, molecules in a gaseous state are also absorbed on the inside surfaces of the pores. When the inside surface area is compared among the containers used in the above measurements, the inside surface area of the sandblasted glass container is larger than that of the glass container (not sandblasted), and the inside surface area of the pottery container is larger than that of the sandblasted glass container. Among them, the inside surface area of the unglazed pottery container is very large. Thus, there are big difference between the containers in the amount of air absorbed thereon. A coarse surface has a higher surface energy than a smooth surface. Since a coarse surface has a higher surface energy than a smooth surface, it is known that an interface between a gas and solid is moistened to lower its surface energy. The amount of air absorbed on the inside surface of the sandblasted glass container is different from that of the glass container (not sandblasted), which seems to be a main cause of variations in amount of froth. In the case of the glass containers sandblasted by a 50- to 1000-mesh powder, the ratio of froth to beer sharply decreased for the second time. This is because the coarse inside surface became smooth by moistening the surface with beer and by expelling air from the surface. In the case of a pottery container, a large amount of air is contained in baked clay. Therefore, even if the inside surface gets wet with beer, the beer is gradually absorbed in the inside surface, so that the surface can return to a coarse condition soon. In the case of a pottery container, the ratio of froth to beer decreases from the second time, but the lasting time of froth is longer than that in a glass container, because glass is not capable of absorbing beer. Thus, porous material for a container contributes to a longer lasting of froth. Even if the inside surface of the container is sandblasted or fine particles are bonded thereto, froth does not last long because a material for the container is not porous. This is not only true of beer, but also for any sparkling beverage. In the case of an unglazed pottery container, capillary pores in the inner surface are penetrated to the outer surface, so that a slight amount of gas goes in and out at the porous, whereby the generation of froth is considered to be induced.

The container for a sparkling beverage according to the present invention is capable of generating froth well and forming a mark or the like on the surface of the beverage with froth, which we can enjoy for a long time.

The bubble generating means according to the present invention can be used in combination with a commercially-available container, and it is capable of forming a mark or the like on the surface of the beverage with froth, which we can enjoy for a long time. The bubble generating means according to the present invention is compact and lightweight, so that it can be easily stored, transported, or carried.

The bubble generating means according to the present invention can be used in combination with various types of commercially-available containers, and can be detachably attached to the container.

The present invention can offer various types of detachable bubble generating means. Those bubble generating means can be used in one or more containers.

Various combinations of a plurality of bubble generating means according to the present invention can be used in one container.

There has thus been shown and described a novel container for a sparkling beverage which fulfills all the objects and advantages sought therefor. Many changes, modifications, variations, and other uses and applications of the subject invention will, however, become apparent to those skilled in the art after considering this specification and the accompanying drawings which disclose the preferred embodiments thereof. All such changes, modifications, variations, and other uses and applications which do not depart from the spirit and scope of the invention are deemed to be covered by the invention, which is to be limited only by the claims which follow.

What is claimed is:

1. A container for a sparkling beverage, comprising:

a bubble generating portion having a coarse surface, said bubble generating portion formed on an inside bottom portion thereof and shaped into a predetermined mark indicating a certain message;

wherein the coarse surface of said bubble generating portion by itself is the sole source of bubbles and generates bubbles in such a manner that an aggregation of said bubbles forms substantially the same shape as the mark on a surface of a beverage when the beverage is poured into the container.

2. The container according to claim 1, wherein said bubble generating portion is formed on an inside bottom surface of the container.

3. The container according to claim 2, wherein said coarse surface is formed by sandblasting one of a glass surface, a plastic surface, and a metal surface by a 50- to 1000-mesh powder.

4. The container according to claim 1, wherein a diameter of a circle equal in area to an aggregation of a part corresponding to a projection of an asperity on said coarse surface is in a range from 4.5 to 40 $\mu$m; said asperities being extracted from a binary image.

* * * * *